US006305911B2

(12) United States Patent
Charron

(10) Patent No.: US 6,305,911 B2
(45) Date of Patent: Oct. 23, 2001

(54) DEVICE AND PROCESS INTENDED FOR TWO-PHASE COMPRESSION OF A GAS SOLUBLE IN A SOLVENT

(75) Inventor: Yves Charron, Longpont sur Orge (FR)

(73) Assignee: Institut Francais du Petrole, Rueil-Malmaison cedex (FR)

( * ) Notice: Subject to any disclaimer, the term of this patent is extended or adjusted under 35 U.S.C. 154(b) by 0 days.

(21) Appl. No.: 09/776,682

(22) Filed: Feb. 6, 2001

Related U.S. Application Data

(62) Division of application No. 09/195,712, filed on Nov. 19, 1998, now Pat. No. 6,210,126.

(30) Foreign Application Priority Data

Nov. 19, 1997 (FR) ..... 97 14604

(51) Int. Cl.[7] ..... F04B 3/00; F04B 23/00; F01C 1/30

(52) U.S. Cl. ..... 417/244; 417/247; 417/251; 418/48

(58) Field of Search ..... 417/62, 205, 244, 417/247, 251, 253; 418/5, 9, 48, 83

(56) References Cited

U.S. PATENT DOCUMENTS 2,903,248 * 9/1959 Walker ..... 417/247
4,580,955 * 4/1986 Karge ..... 418/48
5,628,616 * 5/1997 Lee et al. ..... 415/58.2
5,722,820 * 3/1998 Wild et al. ..... 418/48
5,785,504 * 7/1998 Cote ..... 417/244
5,807,087 * 9/1998 Brandt et al. ..... 418/48
5,820,354 * 10/1998 Wild et al. ..... 417/244

FOREIGN PATENT DOCUMENTS

-781929- * 7/1979 (EP) .
-2407554- * 5/1979 (FR) .
-2424472- * 11/1979 (FR) .
-2534644- * 4/1984 (FR) .
-2724200- * 3/1996 (FR) .

* cited by examiner

*Primary Examiner*—Willis R. Wolfe
(74) *Attorney, Agent, or Firm*—Antonelli, Terry, Stout & Kraus, LLP

(57) ABSTRACT

The invention is a two-phase compression device and a process which provides energy to fluids including an essentially liquid fluid and an essentially gaseous fluid or a fluid having a liquid phase and a gas phase, at least one of the fluids or phases being miscible in at least one other of the fluids or phases which allows mixing of the fluids or phases. A device in accordance with the invention includes at least one two-phase compression element having at least one inlet stage and at least one outlet stage, each one of the stages having an impeller and a diffuser, which mixes the essentially liquid fluid and the essentially gaseous fluid or the phases and which provides energy to each of the essentially liquid and gaseous fluids or phases with the mixture provided from the at least one two-phase compression element being a pressurized liquid or essentially a pressurized liquid.

5 Claims, 5 Drawing Sheets

DEVICE AND PROCESS INTENDED FOR TWO-PHASE COMPRESSION OF A GAS SOLUBLE IN A SOLVENT

CROSS-REFERENCE TO RELATED APPLICATIONS

This application is a divisional of U.S. Ser. No. 09/195,712, filed Nov. 19, 1998 now U.S. Pat. No. 6,210,126.

BACKGROUND OF THE INVENTION

1. Field of the Invention

The present invention relates to a process and to a system for delivering energy to several fluids and simultaneously for mixing them, one of the fluids being miscible in the other fluid or fluids.

2. Description of the Prior Art

The prior art describes various solutions for eliminating acid gases.

One solution consists in injecting the acid gases individually into a reservoir by using centrifugal or reciprocating compressors.

Another procedure consists in injecting the acid gases with another fluid, for example the formation water available in the reservoir. This solution notably has the advantage of eliminating simultaneously the acid gases and the formation water, considered as two pollutants.

Pan Canadian Limited's formation water and acid gas reinjection process, whose main stages are summed up hereafter and described in FIG. 1, is based on this principle.

The fluid coming from production wells is split into an oil phase which is recovered, an aqueous phase and a gas phase circulating respectively in lines 1 and 2. The aqueous phase is stored in atmospheric tanks 3, whereas the gas phase containing the acid gases is processed in an amine treating plant 4 in order to obtain a gas without acid components and a gas with a high acid component content at a pressure close to the atmospheric pressure. The gas fraction rich in acid gases is sent to a compressor 5 and the formation water is sent to a single-phase pump 6. The gas and the formation water, which have separately reached a given pressure level, are then mixed together in a mixer 7. Mixing is performed at a high pressure in order to facilitate dissolution of the gases in the water, the amount of dissolved acid gases increasing with the pressure level. This mixture occurring in the liquid form is then reinjected for example into an underground reservoir by means of a single-phase pump 8 suited to pump liquid single-phase fluids. Upstream from the high-pressure pump, the gas must be entirely dissolved in the liquid and the NPSHA (suction head available in relation to the vapor pressure of the gas) must also be higher than the NPSHR (suction head required at the pump inlet in relation to the vapour pressure).

In the case of high reinjection pressure applications and for production fluids with a high gas content, mixing of the water and of the gas is performed in successive separate pumping, compression and mixing stages.

This process requires equipment which has the drawback of being heavy and expensive, using both single-phase pumps and compressors, as well as many heat exchangers. Furthermore, as dissolution of the acid gases in the water is not instantaneous, it is necessary to use static or dynamic mixers in order to obtain perfect dissolution of the gas in the liquid upstream from the single-phase pumps, thus increasing even further the complexity of the materials, the cost and the overall dimensions of such a system.

SUMMARY OF THE INVENTION

The present invention proposes to overcome the drawbacks of the prior art by adopting a new approach allowing notably to minimize the number of equipments commonly used.

The invention is notably applicable to fluids which occur in an essentially gaseous form and which are miscible or soluble in an essentially liquid fluid.

The present invention notably allows, by means of a single machine, both compression of an acid gas and formation water from an oil reservoir, and mixing of them in an essentially liquid form, the acid gases being particularly soluble in formation water. The liquid mixture obtained can be sent to a storage zone or reinjected in a production well or an aquifer.

The invention is in particular applied to the processing of natural gas containing acid gases, carbon dioxide and/or hydrogen sulfide, which are generally at least partly separated from the natural gas. When present in small amounts, these separated acid gases can be discharged into the atmosphere, directly or after incineration. However, pollution control standards being increasingly stringent, these discharges into the atmosphere are less and less allowed, and it has become necessary to find other solutions compliant with these new standards with a minimum investment.

According to the invention, a two-phase compression device is used capable of delivering energy to several fluids, at least one of the fluids being soluble in at least one other fluid, and of mixing simultaneously the fluids, so as to obtain at the outlet a fluid in an essentially or completely liquid form.

The present invention is a two-phase compression device which delivers energy to several fluids such as an essentially liquid fluid and an essentially gaseous fluid, at least one of the fluids being miscible in at least one other fluid, and allowing mixing of one.

The invention comprises at least one two-phase compression element which mixes the essentially liquid and essentially gaseous fluids and provides each one of them a given energy value, the mixture coming from said two-phase compression element being in a liquid or essentially liquid form and at a given pressure level.

According to an embodiment, the two-phase compression device can comprise at least one inlet stage and/or at least one outlet stage, each of the stages comprising hydraulics which pump an essentially liquid fluid.

The compression device can have at least two sections, the first section providing a mixture Mi with a pressure level Pi and the second section providing from mixture Mi, a mixture Ms with a pressure level Ps, a discharge line for mixture Mi and a delivery line for fluid Mi in the second section, said two sections being separated by a sealing device and the hydraulics of the two sections being mounted "back to back" so as to minimize axial thrust stresses.

The two-phase compression device can comprise a device positioned between two compression stages and suited to mix at least the essentially liquid fluid and the essentially gaseous fluid, for example in cases where these two fluids are introduced at stages of different ranks.

The compression device can also comprise a fluid processing and/or mixing unit, said processing and/or mixing unit being connected to the compression device by fluid delivery and discharge lines, before and after processing.

In some instances, the processing unit comprises a refrigeration device included in the processing unit.

The processing unit can comprise a circuit for cooling at least part of the two-phase mixture withdrawn from the two-phase compression device and/or part of the liquid phase coming from the two-phase compression device.

The compression device comprises for example means for determining parameters linked with the fluid and/or the functioning thereof, data computing and processing means capable of changing the rotating speed of the two-phase compression device and/or of acting on the efficiency of the refrigeration means and/or on the flow rate of the fluid recycled at the level of the cooling circuit.

The object of the invention is also a process for delivering energy to several fluids, at least one of the fluids being miscible in at least one other fluid, and for simultaneously mixing fluids such as an essentially gaseous fluid and an essentially liquid fluid.

The essentially gaseous fluid and the essentially liquid fluid at least are sent to the same two-phase compression device which delivers energy to at least each one of the two fluids, and which mixes the two fluids together in order to obtain at the outlet an essentially liquid fluid at a given pressure.

According to the process, the pressure difference between the fluids to be mixed is for example determined prior to feeding them into the two-phase compression device, and if the value of this difference is less than a set value, the two fluids are sent to the same two-phase compression stage of the compression device, and if the value of this difference is greater than a set value, the fluid with the lower pressure is sent to a stage of the compression device of rank i and the fluid with the higher pressure to a stage of higher rank i+n, number n being determined as a function of the pressure difference.

The process can comprise a stage of withdrawing at least part of the mixture of fluids after passing through a number m of stages of the two-phase compression device, a stage of processing the withdrawn part and a stage of sending the processed part back to a stage of the compression device of a higher rank than the rank of the withdrawal stage.

It is also possible to refrigerate the fluid and/or a fluid such as part of the two-phase mixture withdrawn or at least part of the liquid phase extracted from the two-phase mixture withdrawn or at least part of the liquid coming from the two-phase compression device, and the refrigerated fluid can possibly be recycled.

It is also possible to control the rotating speed of the compression device and/or to control the efficiency of the refrigeration stage and/or to control the flow rate of the recycled fluid.

The invention is particularly well-suited for simultaneous transfer of acid gases and of formation water to an underground reservoir.

In relation to the prior art, the present invention thus has the advantage of simplifying the devices required for compression and mixing of several fluids, for example at least one essentially gaseous fluid and at least one essentially liquid fluid miscible in each other.

The process according to the invention can be applied to all the fields where energy is to be delivered simultaneously to a gas phase and to a liquid phase, the gas phase being soluble in the liquid phase, and the pressure values of the phases can be different.

BRIEF DESCRIPTION OF THE DRAWINGS

Other features and advantages of the invention will be clear from reading the description hereafter, given by way of examples, within the scope of non limitative applications to the transfer of acid gases and of formation water to an underground reservoir or an aquifer, with reference to the accompanying drawings wherein.

DETAILED DESCRIPTION OF THE INVENTION

In order to describe the device according to the invention more clearly, the description given hereafter by way of non limitative example relates to the transportation of acid gases and of a formation water, the acid gases being soluble in the formation water.

Mixing and dissolving of the acid gases in the water are based on physical phenomena which are explained hereafter.

Under equilibrium conditions, dissolution of an acid gas in water, formation water for example, varies with the pressure and the temperature. The dissolution ratio expressed in volume unit of gas per volume unit of liquid under standard pressure and temperature conditions increases respectively when the pressure increases and when the temperature decreases.

Dissolution will take place progressively owing to the diffusion time between the phases, and approach to equilibrium conditions can consequently be produced by increasing the surfaces of contact between the acid gases and the formation water.

In the case of two-phase compression by a rotodynamic type pump, reaching equilibrium conditions is facilitated by the formation of small-size bubbles. These bubbles appear at the junction between the stationary parts and the rotating parts of the pump, where strong shear forces are exerted.

This approach to equilibrium is however slowed down by the coalescence of the bubbles which can appear in the neighborhood of the impellers and/or of the diffusers of the two-phase compression device. For substantially equal performances (manometric head and axial length), it will be advantageous to increase the number of compression cells (impellers and/or diffusers) and to decrease the axial length thereof so as to increase the number of times the size of the bubbles can be reduced.

Figure 1:
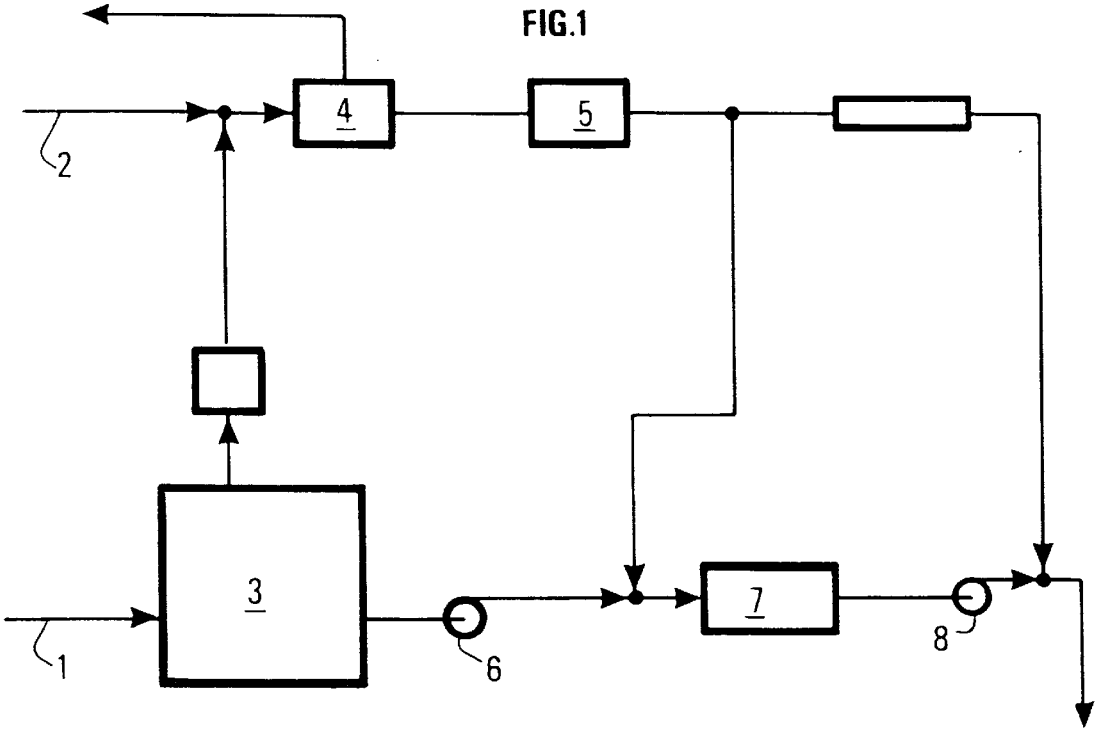
FIG. 1 diagrammatically shows Pan Canadian's process.
Figure 2:
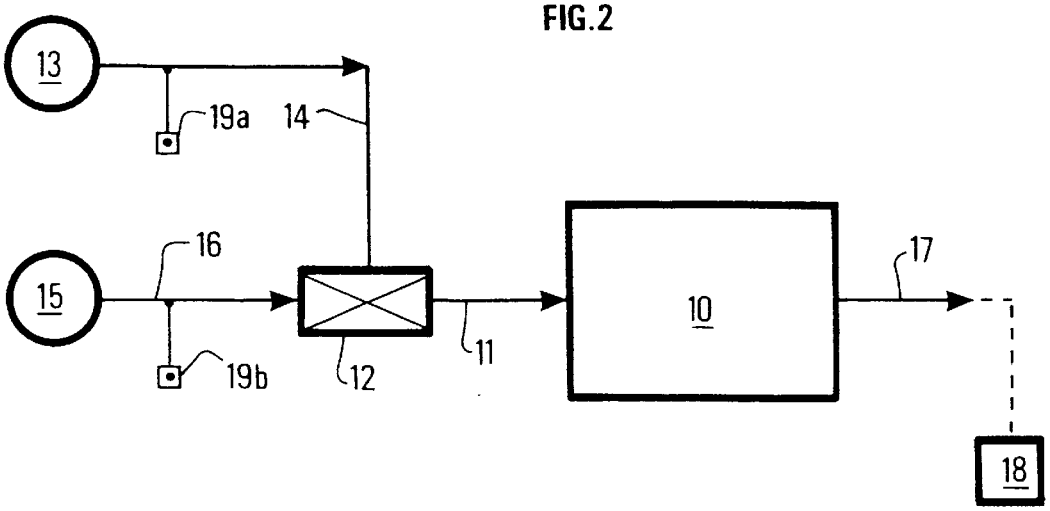
FIG. 2 shows a two-phase compression device suited for implementation of the process according to the invention, FIG. 3 diagrammatically shows an example of layout of two-phase compression stages.

FIG. 2 diagrammatically shows an example of implementation of the process which is suitable when the formation water and the acid gases have similar pressure levels at the inlet of the two-phase compression device, the difference between the pressure levels being slight enough to allow them to be sent to the same stage.

Pumping device or compressor 10 is connected by line 11 to device 12 which receives the acid gases coming from a source bearing reference number 13 through line 14 and, through line 16, the formation water stored in a tank 15.

The acid gases can come from a processing unit as described in the assignee's French Patents 2,605,241 and 2,616,087. At the outlet of these processing units, the acid gases have a pressure that can range between 0.5 and 1.5 MPa and a temperature ranging between −30° C. and −10° C. In case of amine processing units, the pressure is of the order of 0.1 MPa and the temperature ranges between 10° C. and 40° C.

Receiver 12 is selected to favor at least partial dispersion of the acid gases in the form of bubbles in the liquid or at least partial dispersion of the liquid in the form of droplets in the gas.

Two-phase compressor or pumping device 10 is provided with at least one discharge line 17 for the essentially liquid mixture. The pressure level of this mixture at the outlet of the pum/compressor 10 is sufficient to ensure its transfer to an aquifer or an underground reservoir 18.

The initial pressure value of the acid gases and of the formation water can be measured by means of pressure detectors 19*a*, 19*b* situated respectively at the outlet of processing unit 13 and of storage tank 15.

Two-phase compression device 10 comprises at least one pumping stage including an impeller and a diffuser denoted by Ii and Ri in the figures hereafter. The hydraulics of the impellers and diffusers have specific characteristics suited to deliver energy to a two-phase fluid comprising at least one gas phase and at least one liquid phase, the ratio of the volume flow rates of these two phases ranging between 0 and infinity, such as helical-axial impellers. The layout and the characteristics of these hydraulics are the same as those described in one of the Assignee's French Patents 2,333,139, 2,471,501 and 2,665,224. Such a device also allows to dissolve and to mix the acid gases in the formation water in order to obtain an essentially liquid or a liquid mixture.

The number of compression stages used depends on the pressure level required at the outlet.

The two-phase compression device will preferably be designed with impellers with an axial length smaller than the length of the impellers commonly used in the Assignee's aforementioned devices, and with a larger number of impellers so as to keep the same global performance (same outlet pressure for the same total axial length). As explained above, the number of times the gas pockets and macrobubbles form in an impeller can be reduced is thus increased, at the interface between the rotating and the static parts (impeller-diffuser and diffuser-impeller), in the form of microbubbles of a diameter ranging between 1 micron and 1 millimeter.

Figure 11:
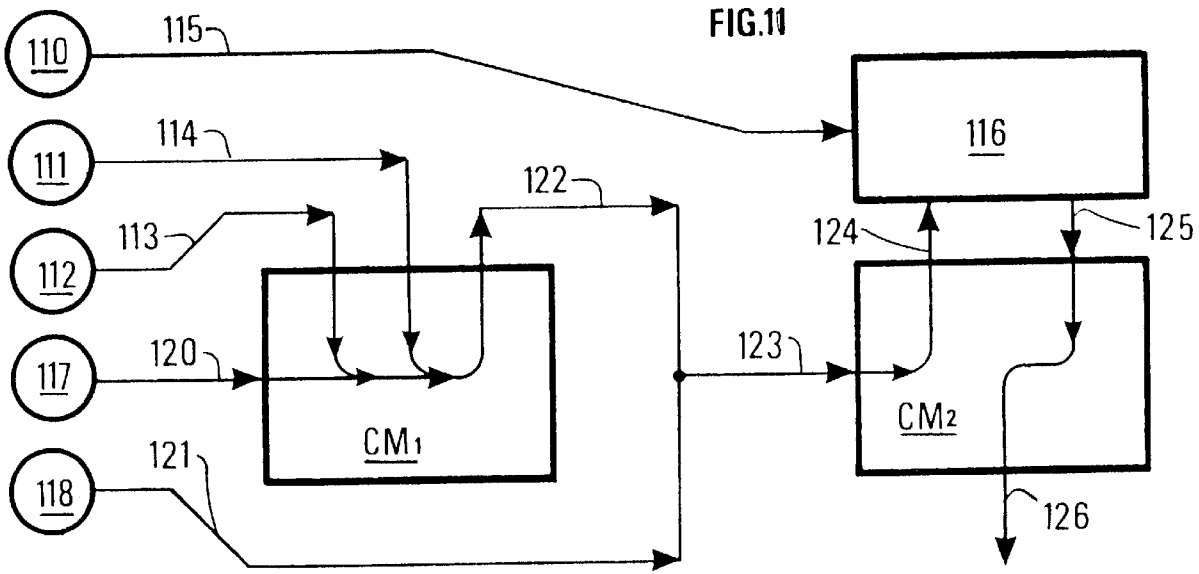
FIG. 11 shows a generalization of the principle according to the invention applied to several liquid and gaseous fluids having different pressure values prior to being fed into the device.

Without departing from the scope of the invention, it is possible for technological reasons to design the compression device in the form of several compression or pumping machine bodies, each one of these bodies having one or more sections and each section comprising one or more compression or pumping stages. An example of such a device made up of several bodies is shown in FIG. 11.

Figure 3:
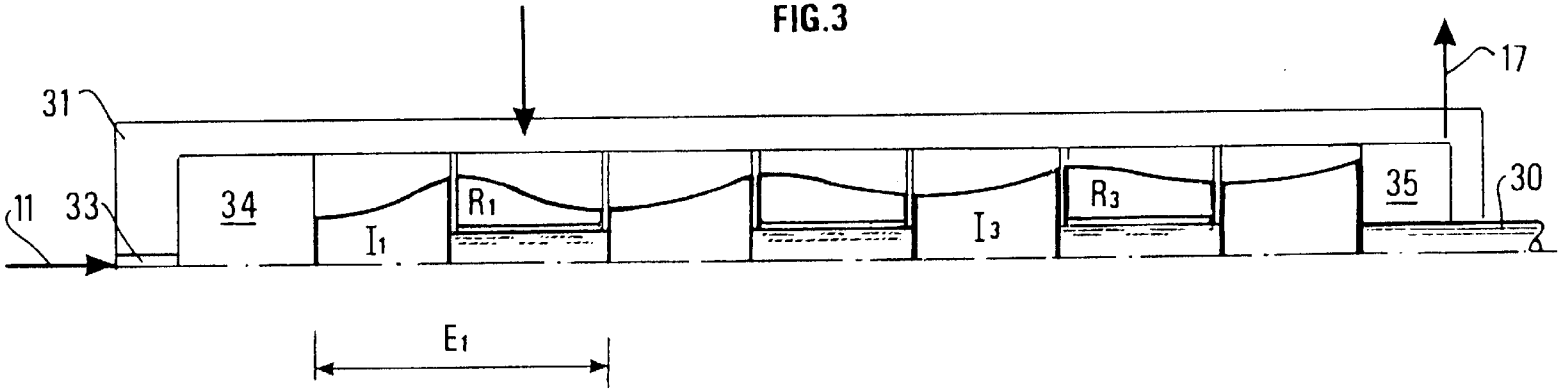

FIG. 3 diagrammatically shows an example of compression device 10 which comprises, in the present case, 4 in-line compression stages $E_1$ to $E_4$.

Each stage Ei of the system comprises an impeller Ii followed by a diffuser Ri, impeller Ii being secured to rotary shaft 30, i denoting the rank of the two-phase compression stage, the stages being included in a housing 31.

Two-phase compression device 10 comprises an opening 33 communicating with fluid delivery line 11 and an inlet chamber 34 placed upstream from the first impeller 11.

In the neighborhood of its outlet, the two-phase compression device can comprise an adapter part such as a volute 35 which converts the kinetic energy into potential energy in order to minimize energy losses at the outlet, connected to line 17 which discharges the essentially liquid mixture.

The acid gases and the formation water introduced at a pressure P0 and a temperature T0 through opening 33, into inlet 34, are compressed in the first stage (I1, R1). At the outlet of this stage, part of the acid gases is dissolved in the formation water in a proportion close to that determined by the dissolution equilibrium conditions at the outlet of stage E1, at a pressure P1 and a temperature T1. The mixture thus obtained M1 is sent to the compression stages of higher rank in order to increase the pressure and to intensify mixing of the acid gases in the formation water until complete dissolution of the acid gases is reached. At the outlet of the two-phase compression device, the mixture MS, containing of the acid gases dissolved in the formation water is discharged through a line 17 in an essentially liquid or in a liquid form, at a pressure Ps and a temperature Ts.

The last pumping stage(s) of the compression device can advantageously comprise hydraulics suited for single-phase fluids, such as radial known impellers. Examples of adaptation of the outlet and inlet stages of the compression device are shown by way of non limitative example in FIGS. 4A and 4B.

Figure 4B:
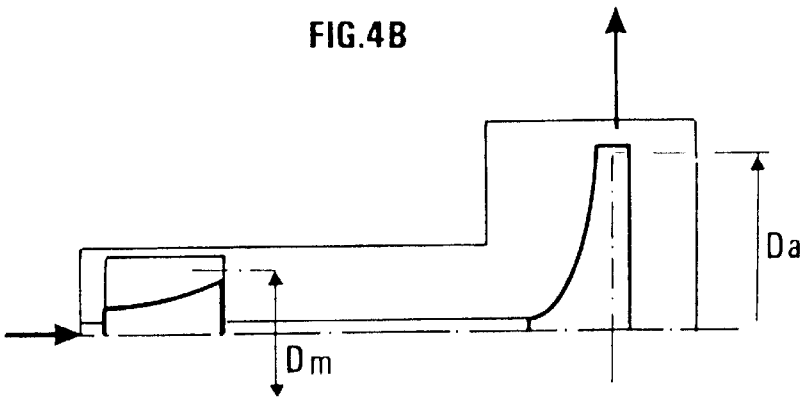
FIGS. 4A and 4B show two embodiments for the inlet and outlet stages of the combined single-phase pumping and two-phase compression device.
Figure 4A:
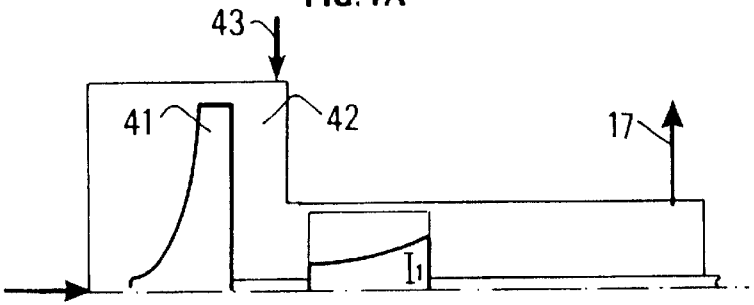

FIGS. 4A and 4B diagrammatically show embodiments of the compression device where the characteristics of the inlet and/or outlet pumping stages are optimized and selected according to the nature of the fluids.

In cases where the acid gases have a markedly higher pressure than the formation water, the acid gases are fed into two-phase compression device 10 through a line 43 at an intermediate compression pressure level, and a device 12 (not illustrated) is no longer used. It is then advantageous to use, for the first compression stages 40, hydraulics (impellers 41 and diffusers 42) which pump a liquid, for example radial wheels as diagrammatically shown in FIG. 4A.

If the acid gases are entirely dissolved in the formation water upstream from the outlet of two-phase compression device 10, it is advantageous to use, for the last compression stages, hydraulics (impellers 45 and diffusers) suited to pump a liquid, for example radial wheels, as diagrammatically shown in FIG. 4B.

In both cases, the outside diameter of the radial impellers, Da, can be larger than the outside diameter of the helical-axial impellers, Dm, in order to reduce the number of single-phase stages to the minimum.

Figure 7:
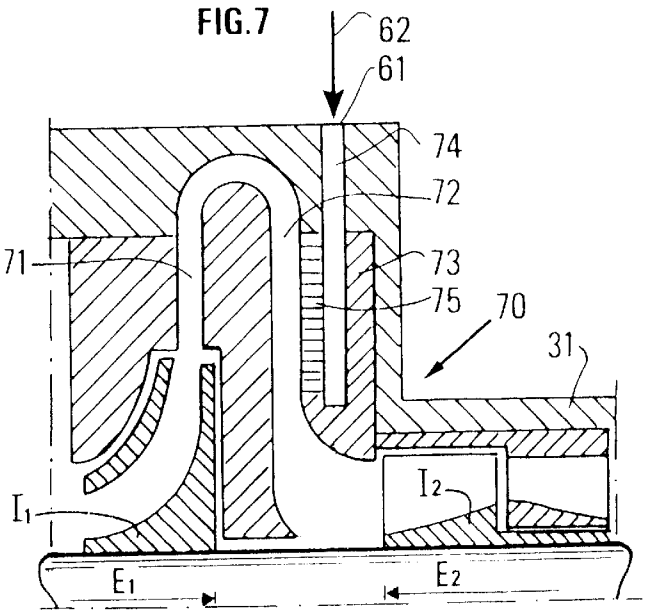

Mechanical-hydraulic adaptation between a multiphase type pumping stage and a single-phase type pumping stage (liquid or gas phase) will be achieved as shown in FIG. 7 in the case of a helical-axial impeller downstream from a radial impeller.

Figure 5:
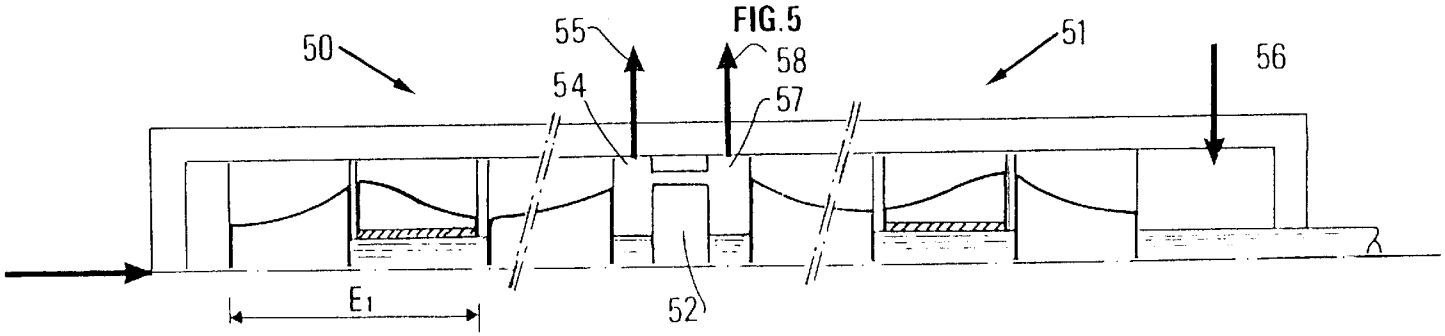
FIG. 5 shows a variation of the system of FIG. 3, FIGS. 6, 7, 8 diagrammatically show a variation of the process suited for fluids with different pressures and the method for introducing them into the two-phase compression device, FIG. 9 diagrammatically shows an embodiment where the mixture of the two fluids can be processed during the compression operation.

FIG. 5 diagrammatically shows a variation of the two-phase compression device made up of two sections 50, 51 where the compression stages are mounted "back to back", the two sections being separated by a sealing device 52, a labyrinth seal for example. The mixture circulates in section 50 in the opposite direction to that of section 51.

According to this variation, section 50 comprises several compression stages EI (Ii, Ri) followed by a volute 54. The mixture consisting of formation water is sent to the first section 50 where it reaches an intermediate pressure level Pi and where at least partial dissolution of the acid gases is performed. The partial mixture Mi is discharged through a line 55 downstream from volute 54.

This mixture Mi coming from first section 50 is then sent to the second section 51 of the compression device through a line 56. The mixture compressed through the compression stages of second section 51 is discharged through a volute 57, then through a line 58 corresponding to the high-pressure outlet of the compression device. While flowing through the second section of the compression device, the pressure of mixture Mi rises to a level Ps sufficient to obtain for almost total dissolution of the acid gases in the formation water allowing to obtain an essentially liquid form Mj.

Such a layout notably has the advantage of minimizing the axial thrust stresses exerted on the shaft in case of high-pressure applications.

Figure 6:
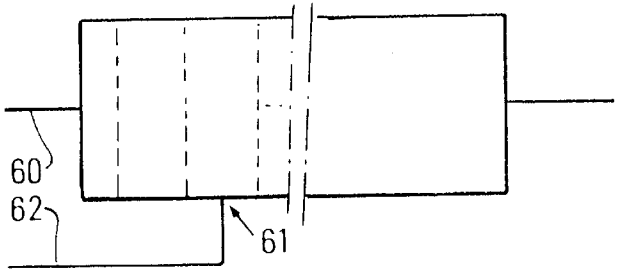
Figure 8:
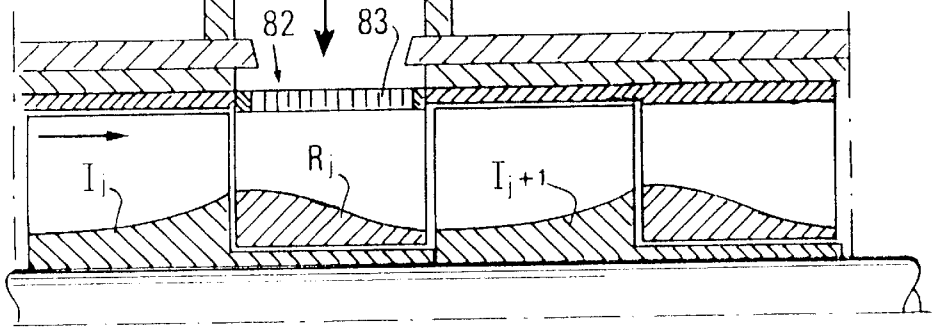

When the acid gases and the formation water have rather different pressure levels at the inlet of the two-phase compression device, it is preferable to send them to different stages of the compression device so as to prevent energy losses. FIGS. 6, 7 and 8 show various realization examples.

FIG. 6 shows a layout suited to the case where the formation water is at a pressure level Pe which is lower than the pressure level Pg of the acid gases. The formation water is introduced through a low-pressure inlet 60 in the first pumping stage whereas the acid gases are introduced through a line 62 connected to an inlet 61 corresponding to a compression stage situated downstream from the inlet stage. The gases are preferably introduced at the level of diffuser Ri of the pumping stage of rank i at the outlet of which the formation water has a pressure level Pe' close to the inlet pressure level Pg of the acid gases.

FIG. 7 shows an example of an acid gas delivery device 70 placed downstream from inlet 61, whose purpose is both to facilitate mixing of the gas and of the liquid, and to direct the mixture towards the inlet of an impeller suited for compression of the two-phase mixture.

Device 70 is situated between impeller Ii of the pumping stage of rank i having for example of a radial wheel and two-phase compression stage E2 consisting of a helical-axial wheel.

Device 70, similar to a known stator stage separating two radial wheels the man skilled in the art, mainly comprises a diffuser 71 for converting the kinetic energy into potential energy and a runback 72.

It also comprises a part 73 including a passage 74 communicating with acid gas delivery line 62 and several channels 75 of very small diameter extending through part 73. These channels open into runback 72 and can be evenly arranged in the radial plane.

In case of a horizontal-joint body, part 73 is directly supported by housing 31.

In case of a vertical-joint body, part 31 and all the internal parts of device 70 form a cartridge mounted inside a cylindrical housing, not shown in the figure. Such a construction is known:

The acid gases are fed into the two-phase compression device successively at the external line 62, through internal line 74 and eventually into runback 72 through channels 75.

The device allows intimate mixing of the gas and of the liquid, the efficiency increasing with the number of channels.

In some application instances, it may be advantageous to introduce a fluid (gas or liquid) at the level of any two-phase compression stage.

FIG. 8 shows in detail an example of layout of the housing 31 of compression device 10 communicating with an auxiliary line 80 delivering a single-phase fluid.

An opening 81 is provided for example at the level of diffuser Rj of the stage of rank j of the compression device. Downstream from opening 81, a device 82 having channels 83 of very small diameter extending therethrough allows the single-phase fluid and to diffuse it in the two-phase mixture from impeller Ij. The new mixture consisting of the two-phase mixture and the single-phase external fluid from diffuser Rj is sent to impeller Ij+1 of the compression stage of rank (j+1). The diameters of the impellers of ranks Ij and Ij+1 are suited to the volume flow rate change due to the introduction of the additional fluid through line 80.

It is also possible to use this layout to introduce additives used in the petroleum sphere, such as anticorrosion or antihydrate additives, or surfactants.

During two-phase compression, it may be advantageous to process the acid gas-formation water mixture in order to activate dissolution.

Processing will for example stabilize the dissolution or cool the acid gas-water mixture whose temperature has risen during compression on account of the compression of the mixture and also in view of the exothermic character of the dissolution reaction. Other processings and their associated devices can be envisaged without departing from the scope of the invention.

Figure 9:
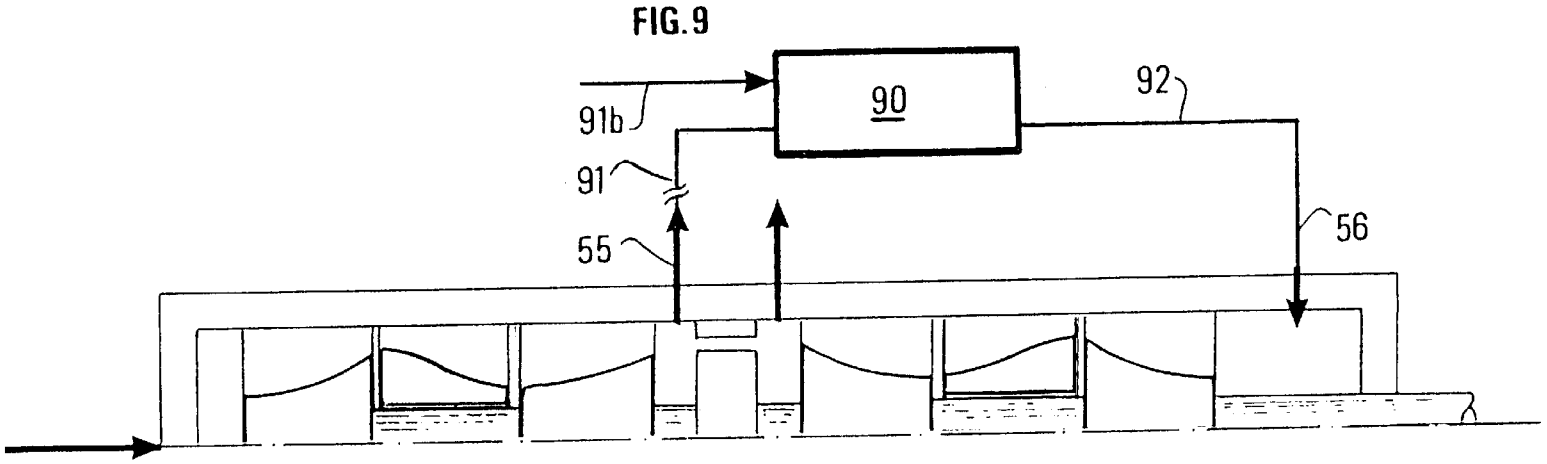

FIG. 9 diagrammatically shows an embodiment where the compression device 10 of FIG. 5 is associated with a processing unit 90 arranged in series.

The mixture Mi coming from medium-pressure outlet 55 is sent through a line 91 to processing unit 90. Downstream from processing unit 90, mixture Mi is thereafter sent through a line 92 to the medium-pressure inlet 56 of the second part of the compression device.

By the mere fact of the flow of the two-phase mixture and of the residence time in lines 55, 91, 92 and 56 and in the processing unit, it is possible to come close to the dissolution conditions defined under equilibrium conditions. As a result, the diameters and the lengths of the pipes situated on either side of processing unit 90 can be calculated so as to adjust this residence time.

The residence times to be observed will possibly be defined from preliminary tests performed under real operating conditions. It will thus be possible to predict the dissolution differences between transient conditions and at equilibrium, and these differences can be expressed in lengths of time or in flow of gas.

The processing unit can comprise a refrigeration system. Refrigeration of the mixture has many advantages:

- it will increase the capacity of the liquid to dissolve the gas under equilibrium conditions,
- it will allow coming close to equilibrium conditions considering the time of residence in the refrigeration system,
- it will allow to increasing the density of the mixture, a parameter favoring compression of a two-phase mixture,
- it will allow a decrease to the ratio of the volume flow rates of gas and of liquid, a parameter which also favors compression of a two-phase mixture.

Figure 10A:
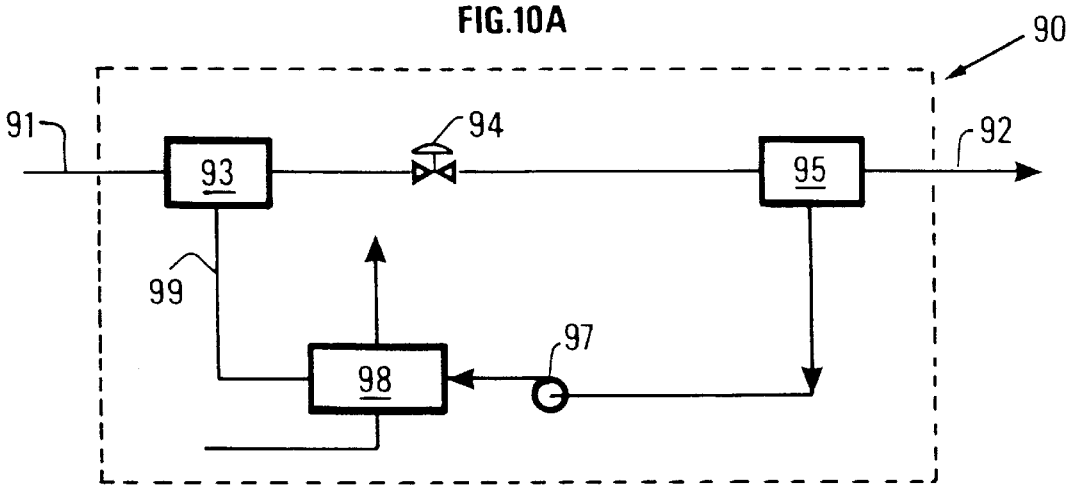
FIGS. 10A and 10B show two devices for recycling the liquid through the refrigeration unit.
Figure 10B:
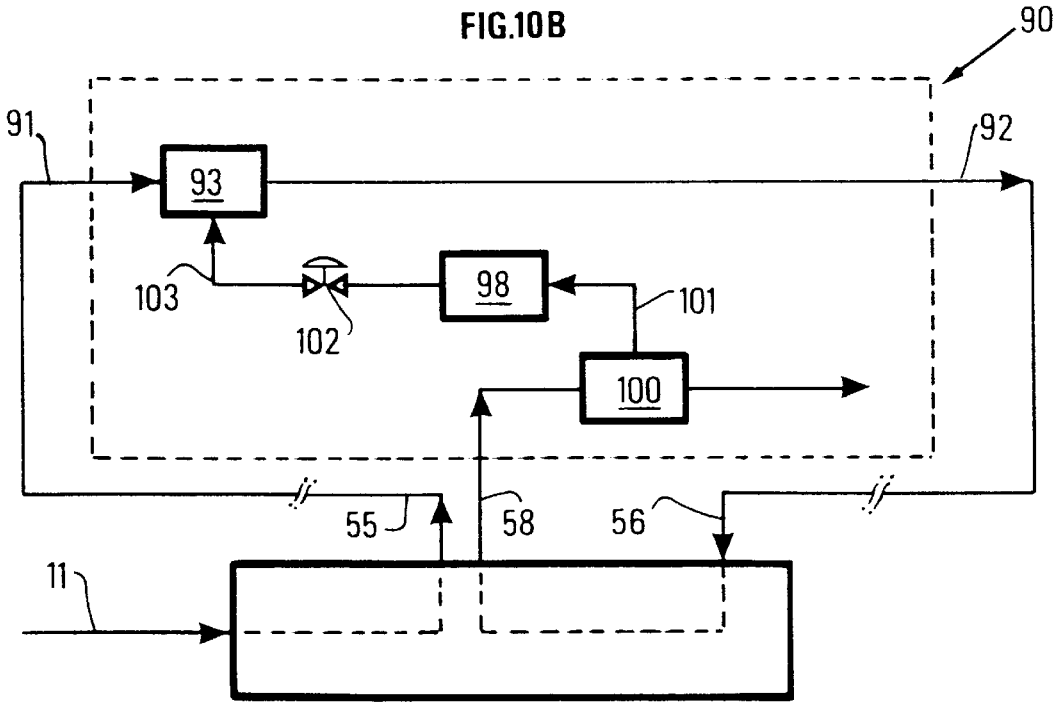

The processing/cooling unit can be designed to cool the two-phase mixture and/or part of the liquid phase taken from this mixture or the liquid coming from the two-phase compression device or part thereof. FIGS. 10A and 10B diagrammatically show two embodiments of the processing device comprising liquid withdrawal and recycling means.

In FIG. 10A, processing unit 90 comprises a static or dynamic type mixer 93 placed on line 91, a pressure drop control valve 94, an extraction device for extracting at least part of the liquid phase contained in the two-phase mixture circulating in line 91, a line 96 and a pump 97 allowing to send the extracted liquid fraction to be cooled to a cooling device such as an exchanger 98 at the outlet of which the cooled liquid fraction is recycled through a line 99 to static mixer 93 in order to be mixed with the fluid circulating in line 91.

When the fluid exhibits a stratified flow in line 91, extraction device 95 are selected to withdraw at least part of the liquid phase at a lower point of the line.

For fluids with an annular flow, extraction device 95 allow extractions of a fraction of the liquid phase on the periphery of line 91.

Pump 97 can be a single-phase pump with a low manometric head.

FIG. 10B diagrammatically shows another embodiment where withdrawal of the liquid phase to be cooled is performed at high pressure on the liquid fluid coming from the compression device.

The processing unit comprises the static or dynamic mixer 93 placed on line 91, extraction device 100 extracts a fraction of liquid from the compression device, which are connected to heat exchanger 98 by a line 101, a valve 102 allowing flow rate control of the liquid cooled in heat exchanger 98, the cooled liquid is being sent through a line 103 to static mixer 93.

The part of the liquid phase that has not been withdrawn, which substantially corresponds to the liquid flow circulating in line 11, is discharged through a line 104.

Recirculation of the cooled liquid to line 91 is allowed under normal conditions without the aid of an additional pump on account of the positive pressure difference between line 58 and line 55.

Such layouts (FIGS. 10A and 10B) will notably allow

- higher efficiency and volume decrease of the exchanger operating at a high or moderately high pressure,
- liquid flow increase in the recycle zone, favoring dissolution of the gas in the liquid.

Processing unit 90 can be equipped with other lines 91*b* allowing a fluid to be added to mixture Mi, for example the aforementioned additives.

FIG. 11 diagrammatically shows a general example of the use of a two-phase compression device comprising two machine bodies $CM_1$ and $CM_2$ forming the two-phase compression device and which are connected to each other by a line 123, suitable for example in the presence of several sources of fluids at different pressure levels.

In this example, the second machine body $CM_2$ is associated with a processing device 116 according to a layout similar to that of FIG. 9.

At the outlet of body $CM_1$, the fluid occurs for example in a multiphase form.

In FIG. 11, the compression device is fed by three acid gas sources 110, 111 and 112 respectively, at pressures $PG_3$, $PG_2$ and $PG_1$, temperatures $TG_3$, $TG_2$ and $TG_1$, with $PG_1<PG_2<PG_3$ for example.

The acid gases $G_1$ (112) and $G_2$ (111) are fed into the machine body $CM_1$ through lines 113, 114 corresponding to different compression stages of the body, whose ranks are determined according to the values of pressures $PG_1$ and $PG_2$.

Acid gases $G_3$(110) are sent through a line 115 to processing device 116.

Two sources of liquid $L_1$ and $L_2$ at respective pressures $PL_1$ and $PL_2$ and temperatures $TL_1$ and $TL_2$ are also shown in this figure.

Liquid $L_1$ (117) is sent through a line 120 to the first body $CM_1$. On the assumption that $PL_1<PG_1$, line 120 is directly connected to the first stage of body $CM_1$, whereas acid gases $G_1$ and $G_2$ are sent to pumping stages of higher rank according to a pattern similar to that of FIG. 6.

The liquid contained in source $L_2$ (118) is directly sent to second body $CM_2$ through a line 121, for example at the level of the inlet stage thereof.

When following the fluid distribution given above, mixing of the fluids and their pressure gain are for example effected as follows:

The pressure level $PL_1$ of liquid $L_1$ increases until it reaches a pressure level substantially identical to the pressure $PG_1$ of gas $G_1$. In the first part of body $CM_1$, acid gases $G_1$ are dissolved in liquid $L_1$ at least partly, the mixture M obtained being at a pressure level P. Acid gases $G_2$ with a pressure level $PG_2$ are sent to the stage at the outlet of which mixture M has a substantially identical pressure level. These three fluids become mixed while passing through the various compression stages of body $CM_1$ the resulting multiphase mixture M' being discharged through a line 122 at a pressure level P'.

Mixture M' from body $CM_1$ is fed with liquid $L_2$ at a pressure $PL_2$ into second body $CM_2$ through a line 123.

At the outlet of the first part of the second body, mixture Mi, which is at an intermediate pressure level Pi, is sent through a line 124 to processing device 116 where it is mixed at least partly with gas $G_3$.

The mixture M'i coming from the processing device is then sent through a line 125 to the second part of body $CM_2$ and flows through the various compression stages. At the outlet of body $CM_2$, an essentially liquid fluid Ms is discharged at a pressure level Ps through outlet 126 for example in an aquifer.

According to another method of operation, it will be possible to make up for differences on the operating parameters of the two-phase compression device from various measurements on the two-phase compression device.

Figure 12:
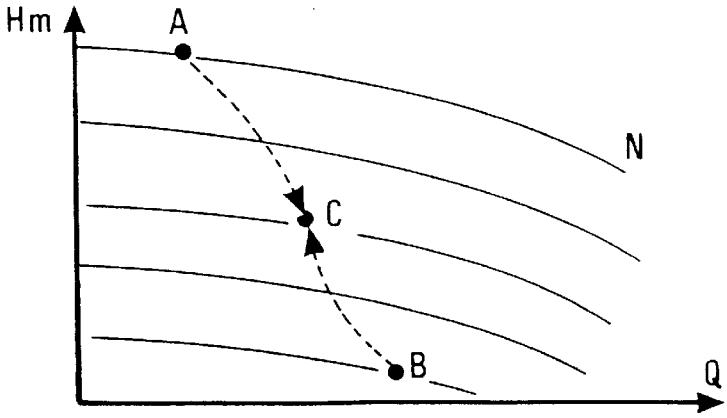
FIG. 12 shows a possible control pattern for the compression device.

FIG. 12 shows, by means of a manometric head (ordinate)—outlet volume (abscissa) diagram, the hydraulic performances of the two-phase compression device for various velocities (N). This diagram includes a wanted working point C, and two points A and B representing two dysfunctioning instances.

When the two-phase compression device is equipped with a suitable measuring system such as pressure, temperature, flow rate, density (or void fraction) detectors, and a control and computing device such as a microcontroller connected to all these elements, it is possible to measure various parameters:

- the flow rate values of the gas phase and of the liquid phase before they are fed into the two-phase compression device Qg and Ql, and to measure for each one the associated temperature and pressure values Tg and Tl, Pg and Pl,
- at the outlet of the compression device, values related to the liquid, such as the pressure Pm, the temperature Tm, the flow rate Qm and the density ρm thereof, to store the characteristic parameters of the gaseous and liquid fluids at the inlet of the compression device, for example the density for the liquid fluid, ρl, the molar mass Mg and the isentropic factor γg for the gaseous fluid, from these various measurements, from the aforementioned data and from suitable data processing, to determine the working point of the compression device and the corresponding velocity curve, and by comparison with a determined value, to check whether this working point belongs to an allowed operating range or to an optimum operating range.

If the working point is outside the desired operating range, it will be possible to act on the rotating speed if the device has a variable-speed drive, and possibly on the efficiency of the refrigeration system or on the flow rate of the recycled liquid according to the design of the compression system.

For example, if point A represents too fast a dissolution with a flow rate that is too low downstream and a pressure that is too high downstream, to overcome this problem it will be possible to intervene by reducing the rotating speed of the two-phase compression device in order to bring working point A to the desired working point C.

Working point B schematizes the opposite case.

The compression device will preferably be equipped with a variable-speed to drive. Speed control can be performed automatically or manually.

COMPARATIVE EXAMPLE

The two-phase compression and mixing device has many advantages in relation to a single-phase compression and mixing system, including a substantial reduction in the number of equipments, resulting in:

more safety in the presence of noxious gases such as $H_2S$, a cost decrease in a corrosive environment and/or an environment subjected to high pressures.

The reduction in the number of equipments mostly depends on the application instances, mainly the GLR and the pressure at the inlet of the compression device. The inlet pressure is approximately equal to the pressure downstream from the deacidizing unit.

A comparative study between two-phase and single-phase (compressor and pump) compression systems has been conducted on the following basis:

a two-phase pump comprising 13 compression stages. The discharge pressure is determined by the two-phase compression device. The same pressure conditions are used for both compression types, two single-phase manometric head values of 150 m and 300 m per two-phase compression stage. The two-phase compression manometric head is obtained by the product of the single-phase head and of the two-phase efficiency, the latter depending on the GLR and on the ratio of the phase densities, a liquid flow rate of 200 $m^3/h$ and a gas flow rate ranging between values corresponding to a GLR of 1 and a GLR of 15, a pressure of 1 MPa abs at the outlet of a physical solvent treating process and of 0.1 MPa at the outlet of a chemical solvent treating process.

The table hereafter gives, in the conditions of the study, the number of compression sections and consequently the number of cooling units (also the number of drums upstream from the compression sections) required for a single-phase compression when one cooling unit at most is required by a two-phase compression.

| GLR of the fluid at the inlet of the two-phase compression device | 1 | 4 | 9 | 15 |
|---|---|---|---|---|
| INSTANCE I<br>Physical solvent treatment<br>Manometric head per two-phase impeller: 150 m | 2 | 2 | 1 | 1 |
| INSTANCE II<br>Physical solvent treatment<br>Manometric head per two-phase impeller: 300 m | 3 | 3 | 2 | 2 |
| INSTANCE III<br>Chemical solvent treatment<br>Manometric head per two-phase impeller: 150 m | 5 | 5 | 5 | 4 |

What is claimed is:

1. A compressor which provides energy to fluids including an essentially liquid fluid and an essentially gaseous fluid, at least one of the fluids being miscible in at least one other of the fluids which allows mixing of the fluids, comprising:

at least one two-phase compression element having at least one inlet stage and at least one outlet stage, each one of the stages having an impeller and a diffuser, which mixes the essentially liquid fluid and the essentially gaseous fluid and which provides energy to each of the essentially liquid and gaseous fluids with the mixture provided from the at least one two-phase compression element being a pressurized liquid or essentially a pressurized liquid; and a device comprising channels which introduce and diffuse a fluid inside the compressor through the channels.

2. A compressor as claimed in claim 1, wherein:

the device is placed between a pumping stage of the compression device and a two-phase compression stage of the compression device, and the device mixes the introduced and diffused fluid with a liquid fluid coming from the pumping stage.

3. A compressor as claimed in claim 1, wherein:

the device is placed at a diffuser of a compression stage of the compressor.

4. A process which provides energy to fluids including and essentially gaseous fluid and an essentially liquid fluid, at least one of the fluids being miscible in at least one of the other fluids, and which mixes the fluids, comprising:

inputting the essentially gaseous fluid and the essentially liquid fluid into a two-phase compression element;

mixing the inputted essentially gaseous fluid and essentially liquid fluid in the two-phase compression element including shearing the fluids between at least one impeller and at least one diffuser of the two-phase compression element and delivering energy to each of the fluids within the two-phase compression element;

withdrawing a part of the inputted essentially gaseous fluid and essentially liquid fluid after passage through a compression stage of the two-phase compression element;

refrigerating the withdrawn part of the inputted essentially gaseous fluid and essentially liquid fluid;

sending the refrigerated withdrawn part of the inputted essentially gaseous fluid and essentially liquid fluid inside the two-phase compression element; and outputting, after mixing and refrigerating the fluids, at an outlet of the two-phase compression element pressurized essentially liquid or pressurized liquid.

5. A process as claimed in claim 4, wherein:

the withdrawn part of the inputted essentially gaseous fluid and essentially liquid fluid is an essentially gaseous fluid.

* * * * *